US009056751B2

(12) United States Patent
Roodenburg et al.

(10) Patent No.: US 9,056,751 B2
(45) Date of Patent: Jun. 16, 2015

(54) HOISTING DEVICE

(75) Inventors: Joop Roodenburg, Delft (NL); Robert Frodo van Kuilenburg, Houston, TX (US); Pieter Dirk Melis van Duivendijk, Missouri City, TX (US)

(73) Assignee: ITREC B.V., Schiedam (NL)

( * ) Notice: Subject to any disclaimer, the term of this patent is extended or adjusted under 35 U.S.C. 154(b) by 529 days.

(21) Appl. No.: 13/264,024

(22) PCT Filed: Apr. 14, 2010

(86) PCT No.: PCT/NL2010/000066

§ 371 (c)(1),
(2), (4) Date: Oct. 12, 2011

(87) PCT Pub. No.: WO2010/120169

PCT Pub. Date: Oct. 21, 2010

(65) Prior Publication Data

US 2012/0025156 A1 Feb. 2, 2012

Related U.S. Application Data

(60) Provisional application No. 61/169,074, filed on Apr. 14, 2009.

(51) Int. Cl.

| | |
|---|---|
| ***B66D 3/08*** | (2006.01) |
| ***B66C 13/02*** | (2006.01) |
| ***E21B 19/02*** | (2006.01) |

(52) U.S. Cl.

CPC . *B66C 13/02* (2013.01); *B66D 3/08* (2013.01); *E21B 19/02* (2013.01)

(58) Field of Classification Search

CPC ..... B66D 3/04; B66D 3/043; B66D 3/06; B66D 3/08; B66D 2700/028; B66C 1/34; E21B 19/02

USPC ..... 254/280, 281, 282, 283, 284, 285, 286, 254/287, 334, 335, 336, 337, 338, 393, 394, 254/395, 396, 397, 398, 400

See application file for complete search history.

(56) References Cited

U.S. PATENT DOCUMENTS

| | | | | | |
|---|---|---|---|---|---|
| 483,161 | A | * | 9/1892 | Morgan | 254/399 |
| 2,259,253 | A | * | 10/1941 | Kozlovskis | 254/399 |
| 3,258,249 | A | * | 6/1966 | Williams | 254/399 |
| 3,768,664 | A | * | 10/1973 | Bauer et al. | 212/310 |

(Continued)

FOREIGN PATENT DOCUMENTS

| | | | |
|---|---|---|---|
| EP | 1 433 922 | A2 | 6/2004 |
| WO | WO 03/062042 | A1 | 7/2003 |

*Primary Examiner* — Emmanuel M Marcelo
*Assistant Examiner* — Justin Stefanon
(74) *Attorney, Agent, or Firm* — Birch, Stewart, Kolasch & Birch, LLP

(57) ABSTRACT

A hoisting device includes a hoisting cable, a winch, a crown block and a traveling bottom block provided with a load attachment device. Both the crown block and the traveling bottom block include one or more sheaves having an essentially horizontally extending rotation shaft about which sheaves the hoisting cable is reeved. At least some of the traveling bottom block sheaves are associated with a releasable connector, and are thereby detachable from the load attachment device and displaceable to an inoperative position. The rotation shaft of multiple traveling bottom block sheaves and multiple crown block sheaves is essentially perpendicular to the rotation shaft of remaining multiple traveling bottom block sheaves and remaining multiple crown block sheaves.

12 Claims, 4 Drawing Sheets

(56) References Cited

Figure 1:
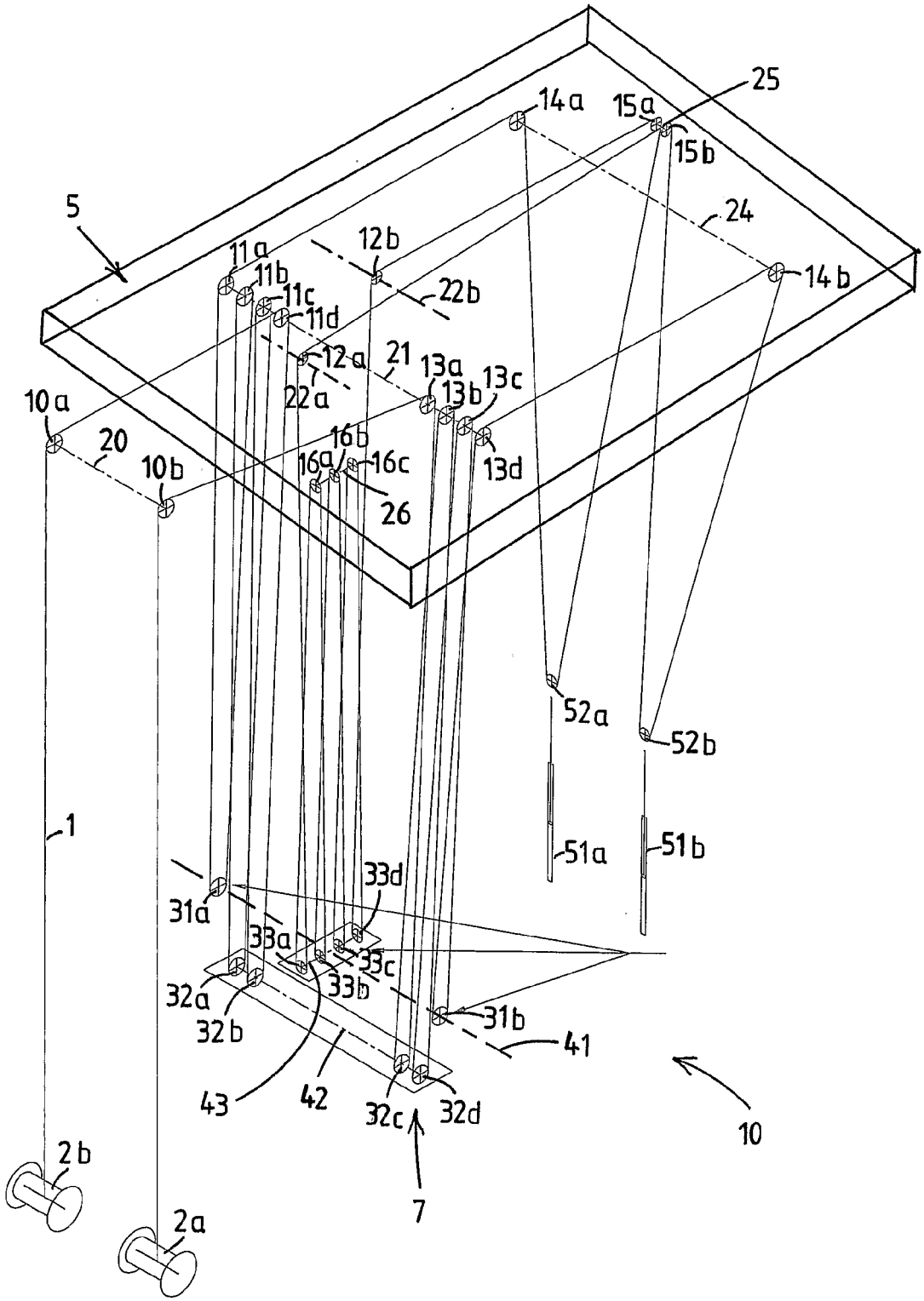

U.S. PATENT DOCUMENTS 3,863,898 A * 2/1975 Brackin ..... 254/399
4,010,852 A * 3/1977 Goss et al. ..... 212/262
5,421,468 A 6/1995 Wright
6,926,103 B1 * 8/2005 Roodenburg et al. ..... 175/203

* cited by examiner

HOISTING DEVICE

This application is a National Phase of PCT/NL2010/000066 filed on Apr. 14, 2010, which claims priority under 35 USC 119(e) to U.S. Provisional Application No. 61/169,074 filed on Apr. 14, 2009, all of which are hereby expressly incorporated by reference into the present application.

The present invention relates to a hoisting device comprising a hoisting cable, a winch, a crown block and a traveling bottom block provided with a load attachment device, wherein both the crown block and the traveling bottom block comprise one or more sheaves having an essentially horizontally extending rotation shaft about which sheaves the hoisting cable is reeved; wherein at least some of the traveling bottom block sheaves are associated with a releasable connector, and are thereby detachable from the load attachment device and displaceable to an inoperative position.

Such hoisting devices are known from the prior art. These hoisting devices are for example used in the offshore industry as drilling derricks on, for example, drilling vessels. Alternatively, these hoisting devices are known to be used in marine pipe laying systems for laying of an offshore pipeline.

Such a system is known e.g. from EP 1 433 922 from the same applicant. The application of such detachable traveling bottom block sheaves enables optimization between speed and power.

The object of the present invention is to provide an improved hoisting device. This object is achieved by a hoisting device characterized in that the rotation shaft of multiple traveling bottom block sheaves and multiple crown block sheaves is essentially perpendicular to the rotation shaft of remaining multiple traveling bottom block sheaves and remaining multiple crown block sheaves.

The effect of such an orientation of the sheaves is that a horizontal longitudinal dimension of the traveling bottom block is reduced. Possibly, but not necessarily, this is accompanied by an enlargement of the perpendicular latitudinal horizontal dimension.

The sheaves of the traveling bottom block are conventionally arranged such that their rotation shaft is essentially parallel to the longitudinal axis of the traveling bottom block. With the sheaves arranged next to each other, the width of the traveling bottom block is similar to the diameter of a sheave and the length of the traveling bottom block is determined by the number of sheaves. Thus, the more sheaves, the larger the longitudinal dimension of the traveling bottom block. The larger the load to be lifted, the more sheaves are required, and thus the larger the longitudinal dimension of the traveling bottom block. In general, the maximum number of sheaves is determined by the maximum load that the derrick will encounter. However this maximum load is only a very limited time needed during operation. Each sheave adds to the fatigue of the hoisting cable and decreases the total efficiency of the system.

As will be further explained below, the application of detachable traveling bottom block sheaves enables optimization between speed and power, and thus tries to minimize this effect by making it possible to choose the optimal reeving for the load encountered. This is advantageous in many operations. Set-ups having between 2 and 10 detachable traveling bottom blocks are quite common. In general, 10-80% of the traveling bottom block sheaves are detachable. Among the advantages of detachable traveling bottom block sheaves are:

- lower line speeds, increased drilling wire lifetime. Because the number of falls (wire parts extending between the crown block and the traveling bottom block) can be adjusted to the load the absolute value of the line speed needed is much less compared to the line speed with a fixed fall configuration. A lower line speed is very beneficial for the lifetime of the wire.
- simple design of drawworks, increased reliability. Because the number of falls can be adjusted to the load the variation in line speed needed is much less compared to the line speed with a fixed fall configuration. Therefore the drawworks design can be much simpler. For example a gearbox is not needed anymore. A less complex winch design increases the reliability and decreases maintenance efforts.
- decreasing trip times, time savings. Because the number of falls can be adjusted to the load the power of the drawworks motors is transferred more efficiently into block speed. Therefore tripping times can be decreased.

A disadvantage of detachable traveling bottom block sheaves is that the width increases. Non-detachable traveling bottom block sheaves can be positioned more close to each other, as no space for removal is required and supports for the sheaves may be shared by two sheaves. Each detachable sheave requires its own supports on either side of the sheave. Thus, the application of detachable sheaves is advantageous, but enlarges the longitudinal dimension of the traveling bottom block.

Once the width of a set of sheaves positioned next to one another exceeds the diameter of the sheaves, it may be beneficial to rotate the set of sheaves to position the horizontally extending rotation shaft perpendicular to the original position of the horizontally extending rotation shaft. As such, the longitudinal dimension of the traveling bottom block is decreased. Reorientation of the sheaves as such does not change the weight of the traveling bottom block.

In particular when a large number of traveling bottom block sheaves is desired, in general in cases where heavy loads are to be lifted and a large number of falls (wire parts extending between the crown block and the traveling bottom block) is desired, it is advantageous to optimize the orientation of the traveling bottom block sheaves according to the present invention. This is in particular beneficial when the traveling bottom block is to be moveable within a structure, such as the crown support structure, such as a tower, pipelay crane, mast or derrick etc. When only a side-by-side arrangement of the sheaves is possible, the number of sheaves is limited by the dimension of the structure in which the traveling bottom block is moveable. Thus, the amount of falls and the maximum load to be lifted is limited by the dimension of the structure. With the arrangement according to the invention, a larger number of sheaves may be positioned in the traveling bottom, block, as multiple of them are arranged perpendicular to the others. A larger number of falls decreases the hoisting cable speed and diminishes hoisting wire damage, and enables larger loads to be lifted.

Making use of both horizontal dimensions also enables the positioning of more sheaves in the vicinity of the point of gravity of the traveling bottom block. It is possible to position more sheaves in the vicinity of the load. As a result of this orientation, a lighter overall weight of the traveling block may be allowable, which is beneficial for the hoisting device.

Preferably, the traveling bottom block sheaves having essentially perpendicular rotation shafts are arranged symmetrically in the traveling bottom block. Even more preferably, the crown block sheaves having essentially perpendicular rotation shafts are also arranged symmetrically in the crown block. Symmetric arrangements within a block ensure stability of the block and the hoist to be loaded with the block.

Positioning multiple crown block sheaves also essentially perpendicular to the rotation shaft of remaining multiple crown block sheaves enables an essentially analogous orientation of the sheaves in the crown block and the traveling bottom block. As such, entanglement of the hoisting cable is prevented. Also, the hoisting cable parts extend as vertical as possible, which is beneficial for the lifetime of the hoisting cable as wear is minimize in such an orientation.

To minimize wear, it is beneficial to position the shafts of the sheaves having essentially parallel rotation shafts with a very small angle (a few degrees maximum) with respect to the horizontal, and/or with respect to each other. Preferably, the essentially parallel traveling bottom block sheave shafts are positioned at small angles, but alternatively it is also possible to position the essentially parallel crown block sheave shafts at small angles. This prevents the hoisting wire to leave the sheave groove at an angle.

Yet another advantage of the hoisting device according to the invention is that the variation in number of traveling bottom block sheaves is enlarged. As a symmetrical traveling bottom block is desired to hoist loads, conventionally two detachable sheaves had to be detached at the same time, resulting in a loss of 4 falls. Thus, the number of falls could only be changed in steps of 4 falls less or more. With the hoisting device according to the present invention, it is possible to detach one sheave at the time, still maintaining a stable and essentially symmetrical traveling bottom block. As such, the number of falls is changeable in steps of 2 falls less or more. It is conceivable to provide the traveling bottom block with only detachable sheaves, or with a mixture of detachable and non-detachable sheaves.

Any arrangement of the traveling bottom block sheaves is possible. It is conceivable to position the shafts of the detachable sheaves perpendicular to the shafts of the non-detachable sheaves (if any), in which it is possible to position the shafts of the non-detachable sheaves parallel to the longitudinal direction of the traveling bottom block, or, on the contrary, to position the shafts of the detachable sheaves parallel to the longitudinal direction of the traveling bottom block. Of course, it is also possible to position the shafts of a set of detachable sheaves perpendicular to the remaining detachable sheaves, and/or to position the shafts of a set of non-detachable sheaves perpendicular to the remaining non-detachable sheaves.

It is possible to position the shafts of all traveling bottom block sheaves in essentially the same horizontal plane, or position them in a staggered way. For example, the shafts of the detachable sheaves may be positioned at a more elevated position than the shafts of the non-detachable sheaves.

In a preferred arrangement of the traveling bottom block, the traveling bottom block sheaves are arranged such that a set of sheaves having a rotation shaft essentially perpendicular to the longitudinal axis of the traveling block is positioned in the middle of the traveling bottom block, above the load attachment device, flanked by two sets of sheaves having a rotation shaft essentially parallel to the longitudinal axis of the traveling block. In an alternative preferred embodiment, the traveling bottom block sheaves may be arranged such that a set of sheaves having a rotation shaft essentially perpendicular to the longitudinal axis of the traveling block is positioned in the middle of the traveling bottom block, above the load attachment device and above a set of sheaves having a rotation shaft essentially parallel to the longitudinal axis of the traveling block.

In a preferred embodiment, the hoisting device comprises between two and twelve detachable traveling bottom block sheaves, of which the rotation shaft is essentially perpendicular to the rotation shaft of the remaining two to twelve traveling bottom block sheaves.

As indicated above, the application of detachable traveling bottom block sheaves enables optimization between speed and power. This now explained.

The hoisting cable is reeved in such a way about the crown block sheaves and the traveling bottom block sheaves that multiple cable parts extend between the crown block and the traveling bottom block. The more cable parts are present between the crown block and the traveling bottom block, the greater will be the load that can be hoisted with the hoisting device, if the hoisting winch remains unchanged. However, in this case the more cable parts are present between the crown block and the traveling bottom block, the lower will be the speed at which the traveling bottom block is moveable with the same winch speed, and thus the speed with which the load is hoisted is lower.

In order to find a good compromise between speed and lifting power, it is generally decided to provide de hoisting device with relatively heavy winches. The heavy winches ensure that the requirement of being able to move the traveling bottom block up and down rapidly can be met in every case. However, that also means that a substantial part of the lifting power is not being utilized for a substantial part of the time. This problem is solved by the provision of detachable traveling bottom block sheaves.

These detachable traveling bottom block sheaves are displaceable from an operative position in which the sheaves are connected to the traveling bottom block, to an inoperative position. Preferably, the displaceable sheave is locked in the inoperative position. The inoperative position is preferably located between the traveling bottom block and the crown block. In the inoperative position the detachable sheave may e.g. be locked to a crown block sheave, but alternatively to a support structure supporting the crown block.

The effect of this measure is that the number of wire parts between the crown block and the traveling bottom block can be set as desired. When locking the detachable sheaves in the elevated inactive position, less wire parts will extend between the crown block and the traveling bottom block, and a relatively low weight can be hoisted. When the detachable blocks are attached to the traveling bottom block in the operative position, a relatively large number of wire parts will extend between the crown block and the traveling bottom block, and the traveling bottom block can be moved at a relatively low speed relative to the crown block. Since the hoisting cable is reeved about the sheaves and the sheaves can be attached as desired in the active or the inactive position, the hoisting cable does not have to be reeved again. That means that the desired number of wire parts can be set in a relatively short time.

For example, drilling operations may require a maximum load of over 1100 metric tons for certain operations, such as handling a casing string or BOP handling. In 95% of the hoisting operations, however, the load to be hoisted is only 400-600 tons. Without detachable traveling bottom block sheaves, this would result in extreme hoisting cable speeds when hoisting loads with less weight. The speed may be such high that the hoisting cable starts slipping in the sheaves. Preferably, the load attachment means are adapted to support between 100 metric tons and 1250 metric tons. Load attachment means adapted to support even higher loads are also conceivable.

The hoisting device according to the invention may be a conventional crane, e.g. suitable to be positioned on a vessel. Alternatively, the hoisting device may be part of a mast, derrick or multipurpose tower as commercially available by the applicant, e.g. for offshore or onshore purposes, e.g. a drilling derrick. Yet alternatively, the hoisting device may be part of pipelay equipment, such as a J-lay tower. As such, the hoisting device may be positioned on a vessel or alternatively on the mainland. The hoisting device comprises a crown block, which is supported by crown block support structure. In the examples indicated above, the crane, mast or derrick respectively are suitable to support the crown block at an elevated position relative to the traveling bottom block. The traveling bottom block may be allowed to move within the crown block support structure.

The traveling bottom block is provided with a load attachment device, which may be e.g. a hook or lifting slings, but may also be a traveling clamp for holding a pipe section to be connected to a pipeline as well as for lowering the pipe line after the pipe section is connected to the pipeline. Preferably, the hoisting device is a drilling derrick, and the load attachment device is suitable to attach a casing string and/or a BOP and/or a riser and/or an X-mas tree.

The traveling bottom block is moveable between a lower position and an elevated position, and as such also the load is moveable between a lower position and an elevated position. In the most elevated position, the traveling bottom block is close to the crown block. The lowest position may be when the traveling bottom block is connectable to the load, or when the traveling bottom block is in contact with the deck of the vessel or the mainland or any other support, supporting the hoisting device.

The hoisting device comprises at least a hoisting cable and a winch. When using a single winch drum, the other end of the hoisting cable is anchored. In a preferred embodiment, the hoisting device comprises two winches, each end of a single hoisting cable being wound onto a separate winch. It is convenient to place both winches close to each other in view of controls, power etc. The winch or winches may be connected to the crown block support structure, such as a crane, mast or derrick, or alternatively to a support for the hoisting device (deck of a vessel, ground of the mainland). Some of the advantages using two winches are:

- winch speed (with both winches in operation the rotational speed of each winch can be half of the speed of a single winch. This is an advantage when operating in active heave compensation mode. Moreover a lower winch speed is beneficial for the lifetime of the hoisting cable);
- reliability (both winches see the same load because the wire tension is the same on both ends. Consequently if one winch fails the other winch can still move the load at full load, although at only half the speed.);
- power (the total power to move the traveling bottom block is now divided over two winches. Consequently the drive system per winch can be smaller and lighter. This is an advantage when going into active heave compensation mode.);
- cut & slip procedure (the cut and slip procedure is replaced by a wire transfer procedure. This can be done without any manual intervention. Changing of the wire is a planned operation which on average takes only 12 hours or less.);
- heave compensation (if for some reason the load is stuck and there is a need for prolonged periods of time to activate the heave compensation (active or passive) the hoisting cable or wire very quickly wears out. By slipping the wire continuously from one winch to another the lifetime of the wire can be extended until the problem is solved. This can be done while the system is operational.)

In a preferred embodiment when using two winches the detachable blocks are in the stationary (middle) part of the wire.

The hoisting device according to the present invention is preferably provided with heave compensation. It has been noted that a hoisting device with detached bottom block sheaves, and thus less sheaves when not needed, according to the present invention reduces the resistance of the hoisting cable. Therefore, operation of the passive heave compensators is more accurate and improved (less tension variations).

The detachable traveling bottom block sheaves are associated with a releasable connector. Such a connector may e.g. be supported by a sheave support in which the sheave with its shaft is supported. A single releasable connector may be provided to connect the detachable sheave to the traveling bottom block and to lock the detachable sheave in the inactive position.

Alternatively, more preferably, separate connectors are provided for these purposes. To connect the detachable sheave to the traveling bottom block, the sheaves may e.g. be associated with a lock or hook, which interacts with a lug or pin on the traveling bottom block. The sheaves can be fixed on the traveling bottom block as desired. Since there will always be a certain tension on the hoisting cable, the detachable sheaves are pulled automatically in the direction of the crown block. For that reason, fastening means can be dispensed with on the top side of the sheaves. In preferred embodiments, the detachable sheave is provided with a safety facility, to prevent falling downwards of the detachable sheave by the force of gravity if the tension is lost completely. To lock the detachable sheave in the inoperative position, the sheave may e.g. be associated with connector means to connect the detachable sheave to the crown block support structure.

Alternatively, the detachable sheave is associated with connector means to connect the detachable sheave to a crown block sheave.

In a preferred embodiment, the hoisting device is provided on a vessel. Such a hoisting device is preferably further provided with one or more compensators for damping movements of the vessel, e.g. as a result of heave and beating of the waves. Preferably, in such a hoisting device the hoisting cable is guided over a compensator block which is connected to an end of the compensator, in such a manner that with the aid of the compensator it is possible to exert force on the hoisting cable. The other end of the compensator can be fastened in a fixed position, e.g. to the deck of the vessel or connected to a crown block support structure. Such a compensator may for example be in the form of a pneumatic or hydraulic cylinder. A preferred location for the cylinders when using two hoisting winches is in the stationary part of the hoisting cable.

The cylinders may also serve as overload/underload protection. By fully extending one cylinder and fully retracting the other it may be prevented that the maximum line tension is exceeded, and the minimum line tension likewise. When the line tension drops below a minimum, the fully extended cylinder is allowed to retract and thus, with a relatively low pressure, exerts additional tension to the line and thereby prevents very low line tensions when an underload is to be lifted. On the other hand, when the line tension is above a maximum as a result of an overload being lifted, the fully retracted cylinder is allowed to extend and thus, with a relatively high pressure, cause a reduced tension in the line and thereby prevents very high line tensions when an overload is to be lifted.

Figure 2A:
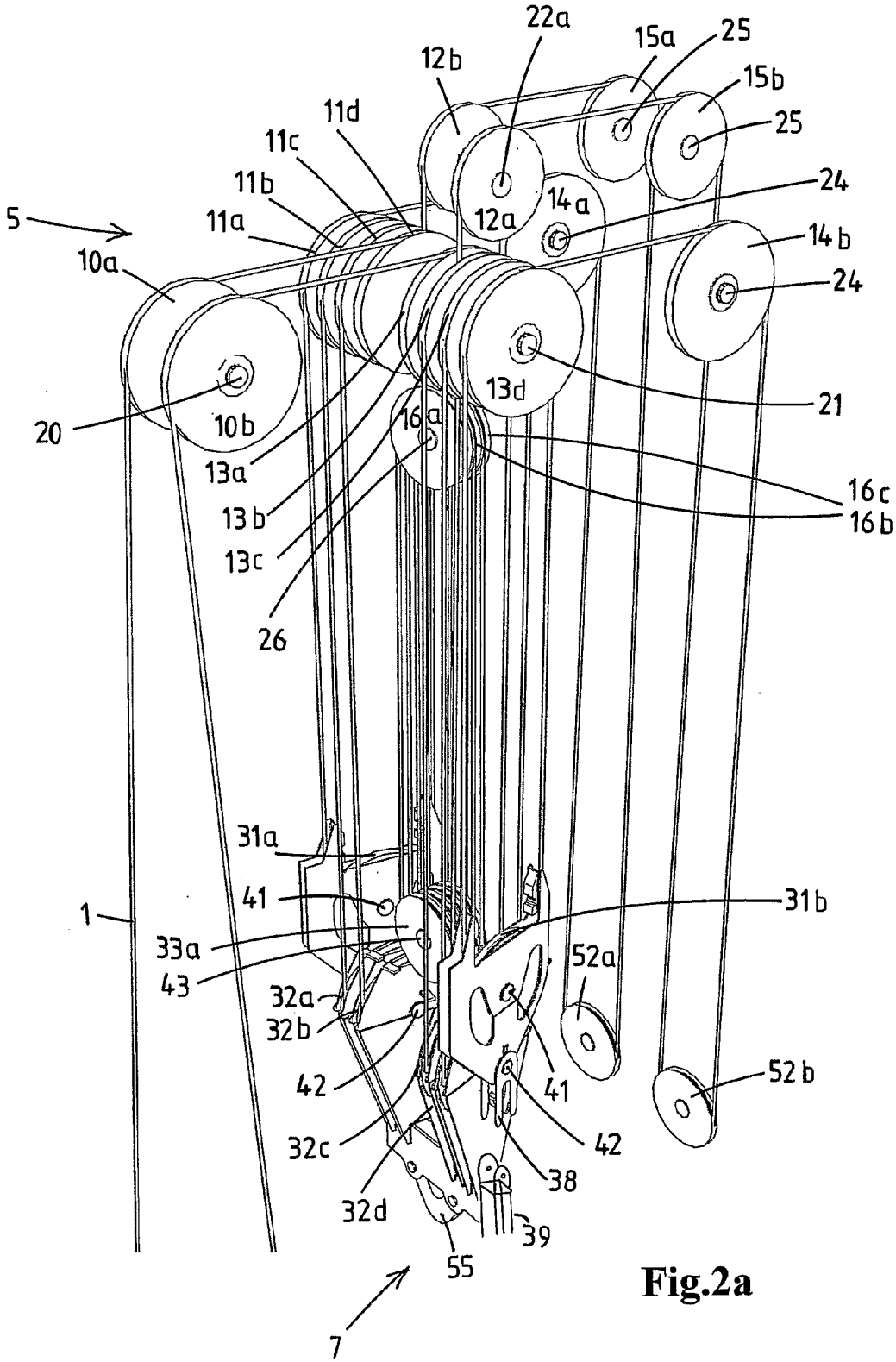
Figure 2B:
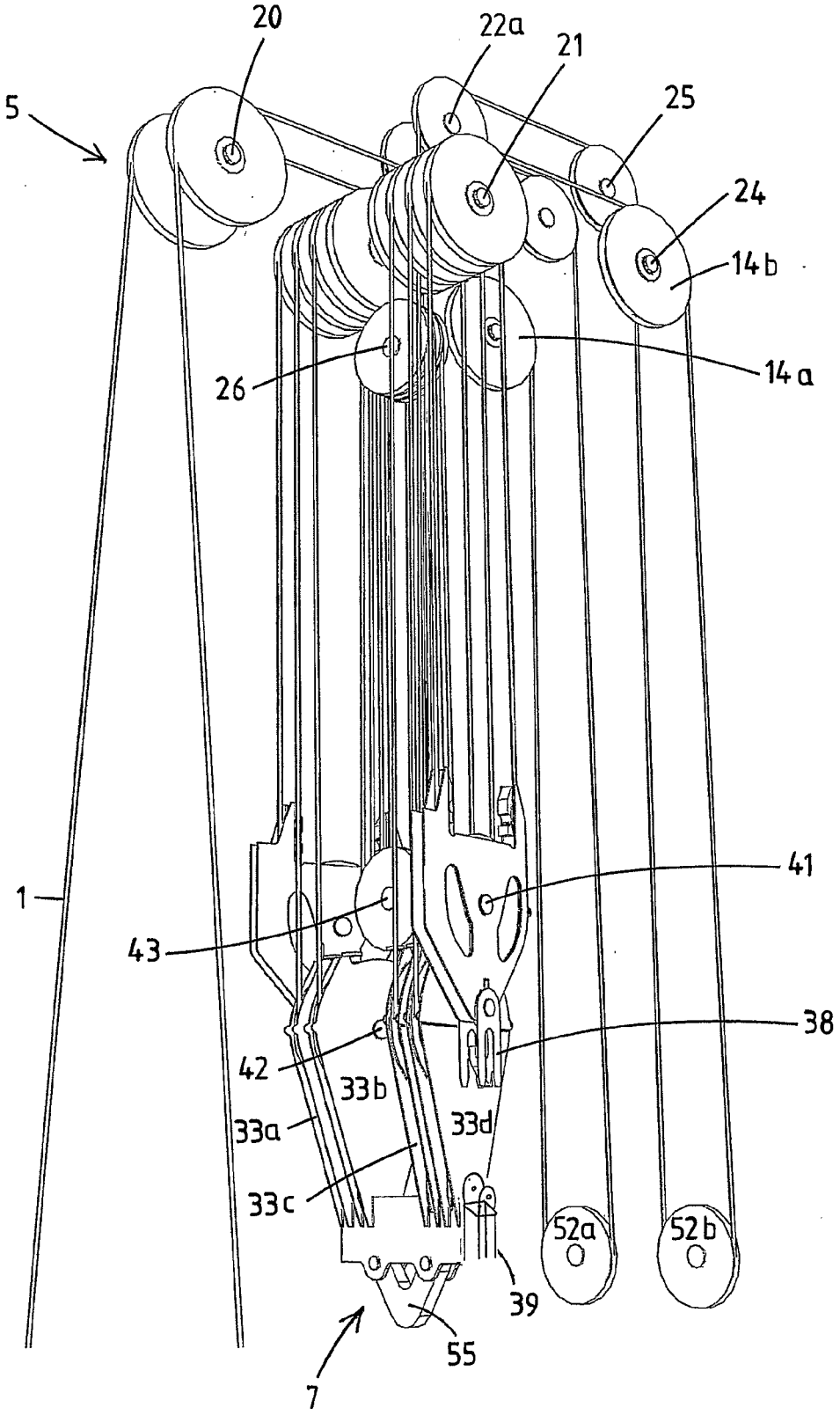
Figure 3:
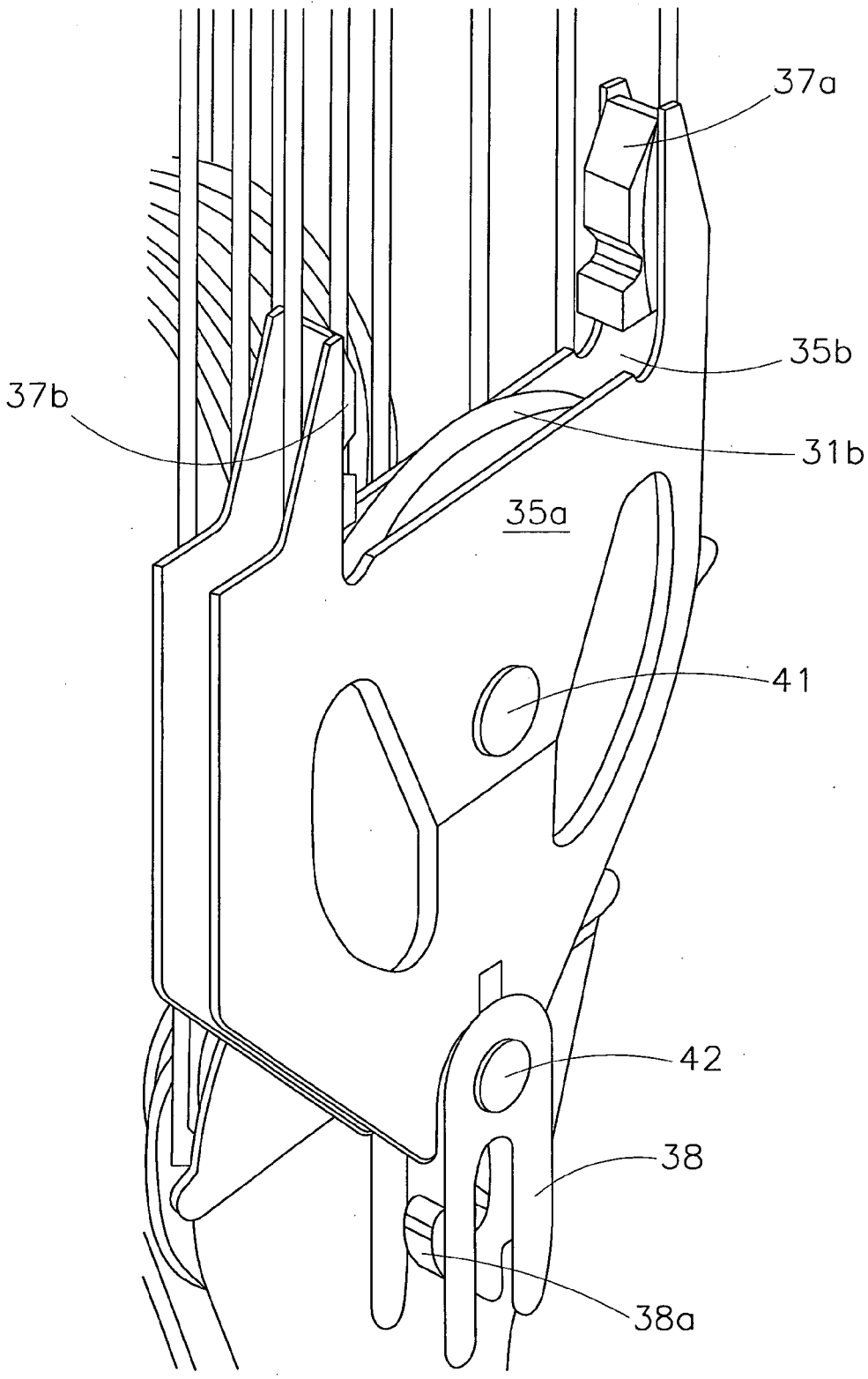

The invention is further explained with reference to the drawing, in which:

FIG. 1 is a schematic representation of a portion of a hoisting device according to the present invention;

FIGS. 2*a* and 2*b* are perspective views of a relative portion of a hoisting device according to the present invention, corresponding to the schematic representation of FIG. 1;

FIG. 3 is an enlarged view of a detachable bottom block sheave, shown in FIG. 2.

In FIG. 1 a hoisting device 10 is schematically depicted. The hoisting device 10 comprises a hoisting cable 1, the two ends of which are attached to two winches 2*a* and 2*b*.

The hoisting device 10 further comprises an elevated crown block 5 comprising multiple sheaves 10*a*, 10*b*, 11*a*, 11*b*, 11*c*, 11*d*, 12*a*, 12*b*, 13*a*, 13*b*, 13*c*, 13*d*, 14*a*, 14*b*, 15*a*, 15*b*, 16*a*, 16*b*, 16*c*. According to the invention, multiple crown block sheaves 16*a*, 16*b*, 16*c* have a horizontally extending rotation shaft 26 essentially perpendicular to the rotation shafts 20; 21; 22*a*; 22*b*; 24; 25 of the remaining multiple crown block sheaves 10*a*, 10*b*; 11*a*, 11*b*, 11*c*, 11*d*, 13*a*, 13*b*, 13*c*, 13*d*; 12*a*; 12*b*; 14*a*, 14*b*; 15*a*, 15*b* respectively. It is noted that the ends of the shafts are visible in FIG. 2*a* or 2*b*, while in FIG. 1 the rotation axis is indicated in dotted lines, the position of which corresponds to the rotation shaft. Therefore, the rotation axis of FIG. 1 has been indicated with the same numbers as the rotation shafts.

The hoisting device 10 further comprises a low-lying traveling bottom block comprising multiple sheaves 31*a*, 31*b*, 32*a*, 32*b*, 32*c*, 32*d*, 33*a*, 33*b*, 33*c*, 33*d*. Some of these traveling bottom block sheaves 31*a*, 31*b*, 33*a*, 33*b*, 33*c*, 33*d* are associated with a releasable connector (not visible in FIG. 1). The connector will be explained further with reference to FIG. 3. The traveling bottom block is provided with a load attachment device 55 (shown in FIGS. 2*a* and 2*b*), from which the traveling bottom block sheaves 31*a*, 31*b*, 33*a*, 33*b*, 33*c*, 33*d* are detachable and displaceable to an inoperative position (not shown).

According to the invention, multiple bottom block sheaves 33*a*, 33*b*, 33*c*, 33*d*, have a horizontally extending rotation shaft 43 essentially perpendicular to the rotation shafts 41; 42 of the remaining multiple crown block sheaves 31*a*, 31*b*; 32*a*, 32*b*, 32*c*, 32*d*, respectively. Rotation shafts 41 and 41 are positioned at a small angle with respect to each other to improve the running of the hoisting line.

According to a preferred embodiment of the invention, the hoisting device 10 further comprises two compensators 51*a*, 51*b* for damping movements of the hoisting device, in particular when the hoisting device is positioned on a vessel. The hoisting cable 1 is guided over compensator blocks 52*a*, 52*b* which are connected to an end of the compensator 51*a*, 51*b*, respectively, in such a manner that with the aid of the compensator it is possible to exert force on the hoisting cable.

The reeving of the hoisting line as shown in FIGS. 1 and 2 has the advantage that reverse bending is minimized.

FIG. 3 is an enlarged view of a detachable bottom block sheave 31*b*, shown in FIG. 2. In this respect it is noted that the application refers to blocks, comprising sheaves with shafts. Possibly, all sheaves are mounted in a single block. More commonly, a block such as the traveling bottom block comprises multiple sets of sheaves, which sheave or set of sheaves are fixed between two supports. As such, the traveling bottom block and/or the crown block may comprise multiple sheaves and/or sets of sheaves, each being supported by two supports. A releasable connector is connected to such a support of a traveling bottom block sheave or a support of a set of traveling bottom block sheaves.

The detachable bottom block sheave shown in FIG. 3 is only an exemplary example of a detachable sheave. The sheave itself is indicated with reference number 31*b*, which sheave is this example fixed between two supports 35*a*, 35*b*. Sheave 36 is rotatable about shaft 41. The detachable sheave 31*b* is associated with a lock 38, comprising clamping portions 38*a*, which may interact (not shown) with a lug or pin 39 on the traveling bottom block (visible in FIGS. 2*a* and 2*b*). As such, the detachable sheave may be connected to the traveling bottom block. To lock the detachable sheave 31*b* in the inoperative position, the detachable sheave 31*b* is associated with a connector 37*a*, 37*b* to connect the detachable sheave to a crown block sheave (not shown). The lock 38 and connectors 37*a*, 37*b* are connected to the supports 36*a*, 35*b*.

The invention claimed is:

1. A hoisting device comprising:

a hoisting cable;

a winch;

an elevated crown block comprising multiple crown block sheaves having an essentially horizontally extending rotation shaft; wherein the crown block has a length defined by its longitudinal axis, and wherein the multiple crown block sheaves are arranged such that a first set of multiple crown block sheaves having a rotation shaft essentially perpendicular to the longitudinal axis of the crown block is positioned in the middle of the crown block, which first set is symmetrically flanked by a second and third set of multiple crown block sheaves having a rotation shaft essentially parallel to the longitudinal axis of the crown block, and a traveling bottom block comprising multiple traveling bottom block sheaves having an essentially horizontally extending rotation shaft, the traveling bottom block being provided with a load attachment device, wherein the traveling bottom block has a length defined by its longitudinal axis, which is essentially parallel to the longitudinal axis of the crown block, and wherein the traveling bottom block sheaves are arranged such that a first set of multiple traveling bottom block sheaves having a rotation shaft essentially perpendicular to the longitudinal axis of the traveling block is positioned in the middle of the traveling bottom block, above the load attachment device, which first set is symmetrically flanked by a second and third set of multiple traveling bottom block sheaves having a rotation shaft essentially parallel to the longitudinal axis of the traveling block, about which crown block sheaves and traveling bottom block sheaves the hoisting cable is reeved, wherein at least some of the traveling bottom block sheaves are associated with a releasable connector, and are thereby detachable from the load attachment device and displaceable to an inoperative position while the hoisting cable remains reeved about these displaceable traveling bottom block sheaves, wherein in the inoperative position the displaceable traveling bottom block sheave is locked directly via the releasable connector of the traveling bottom block sheave to a crown block sheave, which inoperative position is located adjacent to the crown block.

2. The hoisting device according to claim 1, wherein the traveling bottom block has a length, larger than its width.

3. The hoisting device according to claim 1, wherein the hoisting device comprises a group of between two and twelve detachable traveling bottom block sheaves, the rotation shaft of some of which detachable traveling bottom block sheaves of the group is essentially perpendicular to the rotation shaft of the remaining traveling bottom block sheaves of the group.

4. The hoisting device according to claim 1, wherein the load attachment means are adapted to support between 100 metric tons and 1250 metric tons.

5. The hoisting device according to claim 1, wherein the hoisting device is one of a drilling derrick, a crane, a mast, multipurpose tower, pipelaying tower or J-lay tower.

6. The hoisting device according to claim 1, wherein the load attachment device is suitable to attach one or more of a casing string, a BOP, a riser, a pipe section or pipeline, and/or X-mas tree.

7. A hoisting device comprising:

a hoisting cable;

a winch;

an elevated crown block comprising multiple crown block sheaves having an essentially horizontally extending rotation shaft; wherein the crown block has a length defined by its longitudinal axis, and wherein the multiple crown block sheaves are arranged such that a first set of multiple crown block sheaves having a rotation shaft essentially perpendicular to the longitudinal axis of the crown block is positioned in the middle of the crown block, which first set is symmetrically flanked by a second and third set of multiple crown block sheaves having a rotation shaft essentially parallel to the longitudinal axis of the crown block, and a traveling bottom block comprising multiple traveling bottom block sheaves having an essentially horizontally extending rotation shaft, the traveling bottom block being provided with a load attachment device, wherein the traveling bottom block has a length defined by its longitudinal axis, which is essentially parallel to the longitudinal axis of the crown block, and wherein the traveling bottom block sheaves are arranged such that a first set of multiple traveling bottom block sheaves having a rotation shaft essentially perpendicular to the longitudinal axis of the traveling block is positioned in the middle of the traveling bottom block, above the load attachment device, which first set is symmetrically flanked by a second and third set of multiple traveling bottom block sheaves having a rotation shaft essentially parallel to the longitudinal axis of the traveling block, about which crown block sheaves and traveling bottom block sheaves the hoisting cable is reeved, wherein at least some of the traveling bottom block sheaves are associated with a releasable connector, and are thereby detachable from the load attachment device and displaceable to an inoperative position while the hoisting cable remains reeved about these displaceable traveling bottom block sheaves, wherein in the inoperative position the displaceable traveling bottom block sheave is locked directly via the releasable connector of the traveling bottom block sheave to a support structure supporting the crown block, which inoperative position is located adjacent to the crown block.

8. The hoisting device according to claim 7, wherein the traveling bottom block has a length, larger than its width.

9. The hoisting device according to claim 7, wherein the hoisting device comprises a group of between two and twelve detachable traveling bottom block sheaves, the rotation shaft of some of which detachable traveling bottom block sheaves of the group is essentially perpendicular to the rotation shaft of the remaining traveling bottom block sheaves of the group.

10. The hoisting device according to claim 7, wherein the load attachment means are adapted to support between 100 metric tons and 1250 metric tons.

11. The hoisting device according to claim 7, wherein the hoisting device is one of a drilling derrick, a crane, a mast, multipurpose tower, pipelaying tower or J-lay tower.

12. The hoisting device according to claim 7, wherein the load attachment device is suitable to attach one or more of a casing string, a BOP, a riser, a pipe section or pipeline, and/or X-mas tree.

* * * * *